US006170672B1

(12) United States Patent
Boettcher

(10) Patent No.: US 6,170,672 B1
(45) **Date of Patent: *Jan. 9, 2001**

(54) ADJUSTABLE STORAGE RACK FOR ANILOX ROLLS

(76) Inventor: Michael R. Boettcher, 1111 Hill Dr., Oneida, WI (US) 54155

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/339,273

(22) Filed: Jun. 23, 1999

(51) Int. Cl.[7] ..... A47F 7/00
(52) U.S. Cl. ..... 211/13.1; 211/85.5; 211/198
(58) Field of Search ..... 211/13.1, 70.6, 211/60.1, 85.5, 198, 41.14, 208; 296/100.18; 312/3–6; 248/670–671, 166, 172

(56) References Cited

U.S. PATENT DOCUMENTS

| | | | | |
|---|---|---|---|---|
| 223,667 | * | 1/1880 | Church | 211/198 |
| 613,760 | * | 11/1898 | Cronin | 211/85.5 |
| 1,104,004 | * | 7/1914 | Rathbone | 211/85.5 |
| 1,605,506 | * | 11/1926 | Brunhoff | 211/198 |
| 1,637,250 | * | 7/1927 | Ashing | 211/13.1 |
| 1,792,612 | * | 2/1931 | Staley | 248/166 |
| 1,978,290 | * | 10/1934 | Arthur | 211/85.5 |
| 2,002,128 | * | 5/1935 | Reidenbaugh | 211/198 |
| 2,122,770 | * | 7/1938 | Colin | 211/13.1 |
| 2,588,529 | * | 3/1952 | Hume | 211/85.5 |
| 2,999,693 | * | 9/1961 | Thorson | 211/13.1 |
| 3,249,232 | * | 5/1966 | Pokorski | 211/198 |
| 3,388,806 | * | 6/1968 | Cunningham, Jr. et al. | 211/85.5 |
| 3,409,141 | * | 11/1968 | Cunningham, Jr. et al. | 211/85.5 |
| 4,400,043 | * | 8/1983 | Rossow | 312/3 |
| 4,643,317 | * | 2/1987 | Wilkinson et al. | 211/60.1 |
| 4,666,038 | * | 5/1987 | Minneman | 211/198 |
| 4,779,914 | * | 10/1988 | Friedline | 211/198 |
| 5,139,160 | * | 8/1992 | Romano | 211/13.1 |
| 5,209,539 | * | 5/1993 | Atalay | 211/70.6 |
| 5,284,256 | * | 2/1994 | Correll-Antoun | 211/198 |
| 5,556,064 | * | 9/1996 | Cowe | 248/166 |
| 5,692,625 | * | 12/1997 | Filipescu et al. | 211/13.1 |
| 5,718,490 | * | 2/1998 | Liao | 312/3 |
| 5,975,314 | * | 11/1999 | Lee | 211/13.1 |

* cited by examiner

*Primary Examiner*—Robert W. Gibson, Jr.
*Assistant Examiner*—Jennifer E. Novosad
(74) *Attorney, Agent, or Firm*—Ryan Kromholz & Manion, S.C.

(57) ABSTRACT

A rack for protecting and storing anilox rolls and the like. The rack includes a base and a protective environment. A support structure is mounted on the base but within the protective environment. The support structure is provided with support members for releasably supporting delicate rolls, such as anilox rolls. The rack minimizes the incidence of damage to anilox or other delicate rolls during storage, and permits safer removal of the rolls from the rack.

5 Claims, 11 Drawing Sheets

ADJUSTABLE STORAGE RACK FOR ANILOX ROLLS

FIELD OF INVENTION

The invention is an adjustable storage rack for storing anilox rolls.

BACKGROUND OF THE INVENTION

Anilox rolls are ink transfer rolls used in printing processes. Some anilox rolls are metal rolls that have had the periphery of the roll mechanically engraved. Other rolls are metal rolls, with a sprayed-on ceramic coating, covering the periphery of the roll. The roll surface on the ceramic covered rolls is laser engraved, with a fine pattern machined into the periphery of the roll.

The engraved surface on the anilox roll is used to transfer ink from a reservoir to a rubber roll. The rubber roll transfers the ink to an image on a printing plate. The printing plate transfers the image to a paper web.

When an anilox roll surface is damaged, for example from being hit by a metal tool, or is otherwise damaged, the pattern formed in the periphery of the roll, is broken. The broken pattern deteriorates the quality of the image printed by the printing plate. Because of the damage, either not enough, or too much ink is transferred to the rubber roll that inks the printing plate. The damage to the anilox roll results in a poor image printed by the printing plate on the paper web.

Repair of damage to anilox rolls is expensive, specialized, and labor intensive. The damaged area is cut out, filled with metal, and re-engraved by hand. If more than a few areas are damaged, replacement of the whole roll is necessary.

The common method of storing anilox rolls when not in use, is to put the smaller anilox rolls in a cabinet. No effort is made to protect the delicate ink transfer surface of the anilox roll. Larger anilox rolls are removed from printing machines, with chain falls, and overhead hoists. The larger anilox rolls are then stored on anilox roll storage racks.

The common anilox storage rack is an I-Beam constructed rack, on which the rolls are mounted. The anilox rolls are mounted one after another, on a storage arm, that is parallel to the floor. There is no separation between the rolls on this type of storage rack. The rolls roll up against each other, and damage the print surface.

The support arms on prior racks are angle iron. The support arms also damage the roll surfaces. When the rolls are removed from the current storage racks, it is difficult not to contact either the storage rack surface, or another roll as the heavy rolls are lifted off the rack, and removed to the printing machine. Every time a roll is taken from the rack, or put back in the rack, damage occurs to the delicate perimeter of the anilox roll.

When the rolls are stored on a rack frame, the anilox rolls are also susceptible to being bumped into by employees carrying hard items, being bumped by lift trucks, and being damaged by any number of items being moved to, or dropped in the plant, including other anilox rolls being transferred from the storage rack to a printing machine.

The present invention is a modified storage rack, designed by the inventor, after examining many storage racks currently used. The invention is designed to protect the delicate periphery of the anilox roll when the roll is stored, removed from storage, and placed back into storage. In particular, the invention provides a protective environment.

The inventor has designed, and then sold, padded chemical proof roll covers for anilox rolls. These padded covers protect the delicate surface of the anilox rolls. In designing the covers, the inventor became immersed in, and familiar with, storage of anilox rolls, in industry use. The inventor became familiar with sources of surface damage to the anilox rolls. Based on the observations, the inventor designed the below described storage racks to minimize damage to anilox rolls, in storage, in removing from storage, and in putting back into storage.

SUMMARY OF THE INVENTION

The invention is an improved adjustable storage rack for anilox rolls. Three storage racks were designed, with the same central concept, that is, providing storage and support of anilox rolls within a protective environment. The storage facility is varied according to the particular anilox rolls. The protective environment may take various forms. One embodiment includes an inner frame inside a protective outer frame and storing the anilox rolls at an angle within the inner frame. The angled inner frame, and protective hooks, were designed to minimize roll contact in removing the rolls from the storage rack, and placing the rolls back into the storage rack.

The storage rack is wedge shaped, with an angular adjustable inner rack for receiving and storing anilox rolls, and an outer rack that acts as a protective frame for anilox rolls stored within the frame. On larger racks, where there is enough room, the anilox roll storage is totally within the outer frame.

The angle of storage in the inner rack is designed so that when the rolls are removed from the storage rack, it is easy to add and remove rolls from the rack, without bumping one anilox roll against another anilox roll.

On smaller racks, there is not enough room to fit all of the suspended anilox rolls the outer frame.

Since most of the damage to the anilox rolls occurs close to the factory floor, an alternate design suspends the anilox rolls within the outer frame, at least on the bottom part of the storage rack. A bumper guard is added to the smaller frame. A line extending from the bumper guard to the top of the frame would have all the suspended anilox rolls within an extended imaginary plane from the bottom of the rack to the top of the frame.

Alternative plastic covers are provided, that are hinged to the frame, and extend across an imaginary plane, from one side of the outer frame to the other, protecting the stored anilox rolls.

Since not all anilox rolls have the same configuration, another embodiment includes an abbreviated version of the inner support rack. This version includes a supporting frame having inwardly extending anilox roll support pegs. The support pegs accommodate anilox rolls having a compatible distal end.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The invention is a storage rack for storing anilox rolls and other heavy cumbersome rolls that have a delicate outer surface.

Figure 1:
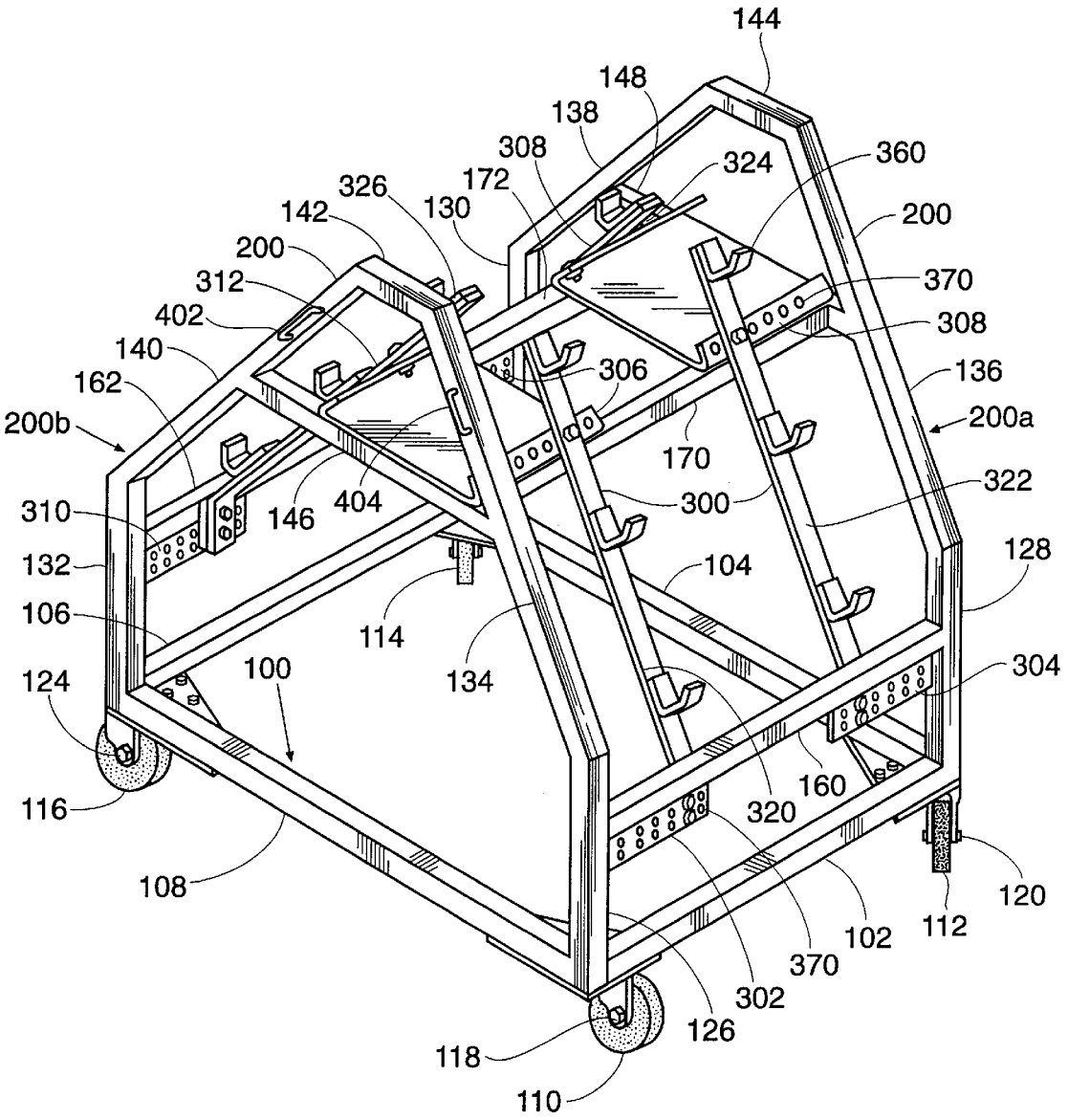
FIG. 1 is a perspective view of a large roll storage rack.

As best seen in FIG. 1, the storage rack designated generally by the reference numeral 10, is formed of the following listed parts.

The base 100 of the storage rack 10, is rectangular. Extensions 102, 104, 106 and 108 form the rectangular base 100. Wheels 110, 112, 114 and 116 are mounted to extensions 102 and 104. The wheels 110, 112, 114, and 116 are mounted on axles 118, 120, 122 and 124. The wheels 110, 112, 114 and 116 within their axles 118, 120, 122, and 124, depend from the rectangular base 100. Two of the wheels, 110 and 116, are fixedly mounted, whereas the wheels 112 and 114 are in the form of casters, and are pivotally mounted to base 100. Anilox rolls 20 are supported and protected in the present embodiment, in an area defined by the respective peripheries of outer protective frames 200*a*, 200*b*. The frames 200*a*, 200*b* are substantially identical in configuration.

Figure 3:
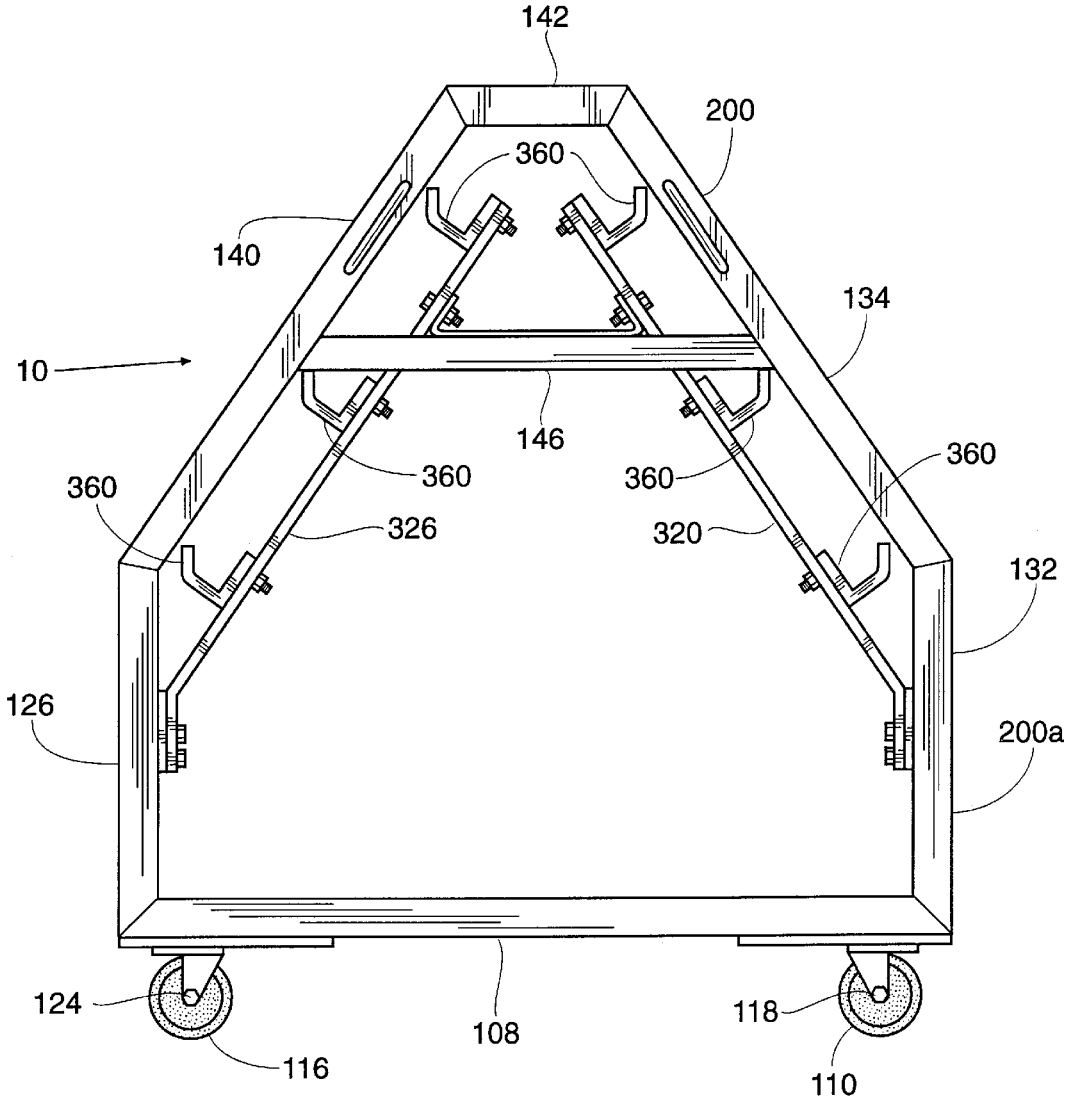
FIG. 3 is a side view of the large roll storage rack.
Figure 4:
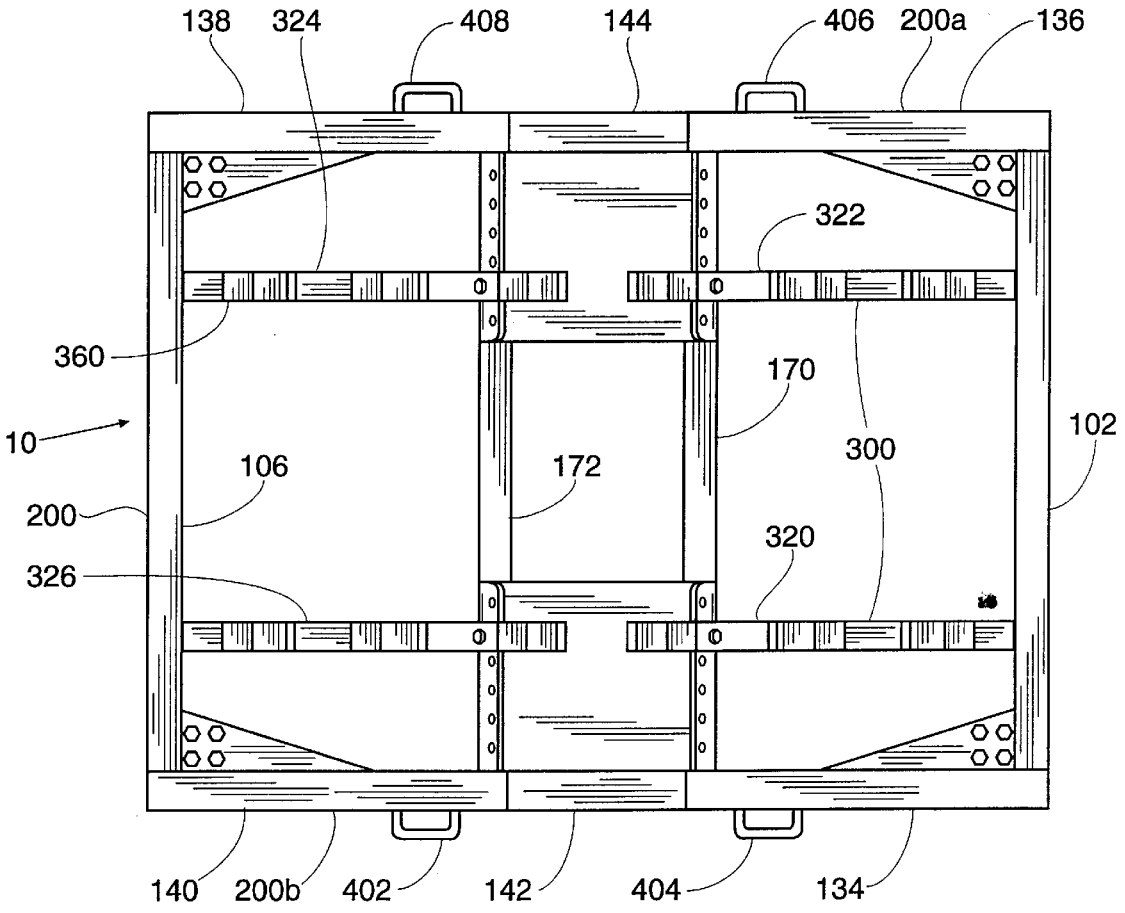
FIG. 4 is a top view of the large roll storage rack.

As best seen in FIGS. 1 and 3, the outer protective frame 200*a*, 200*b* comprise integrally formed structures. These structures include uprights 126, 128, 130 and 132 mounted perpendicular to the base 100, and extend upwardly. Angular supports 134, 136, 138 and 140 are fixedly mounted to the uprights 126, 128, 130, and 132, and extend at an angle upwardly toward connecting pieces 142 and 144, and connecting pieces 146 and 148, respectively.

Extensions 102 and 104, uprights 126, 128, 130, and 132, angular supports 134, 136, 138 and 140, and connecting pieces 142, 144, 146 and 148 form the ends of the outer protective frames 200*a*, 200*b*.

Figure 2:
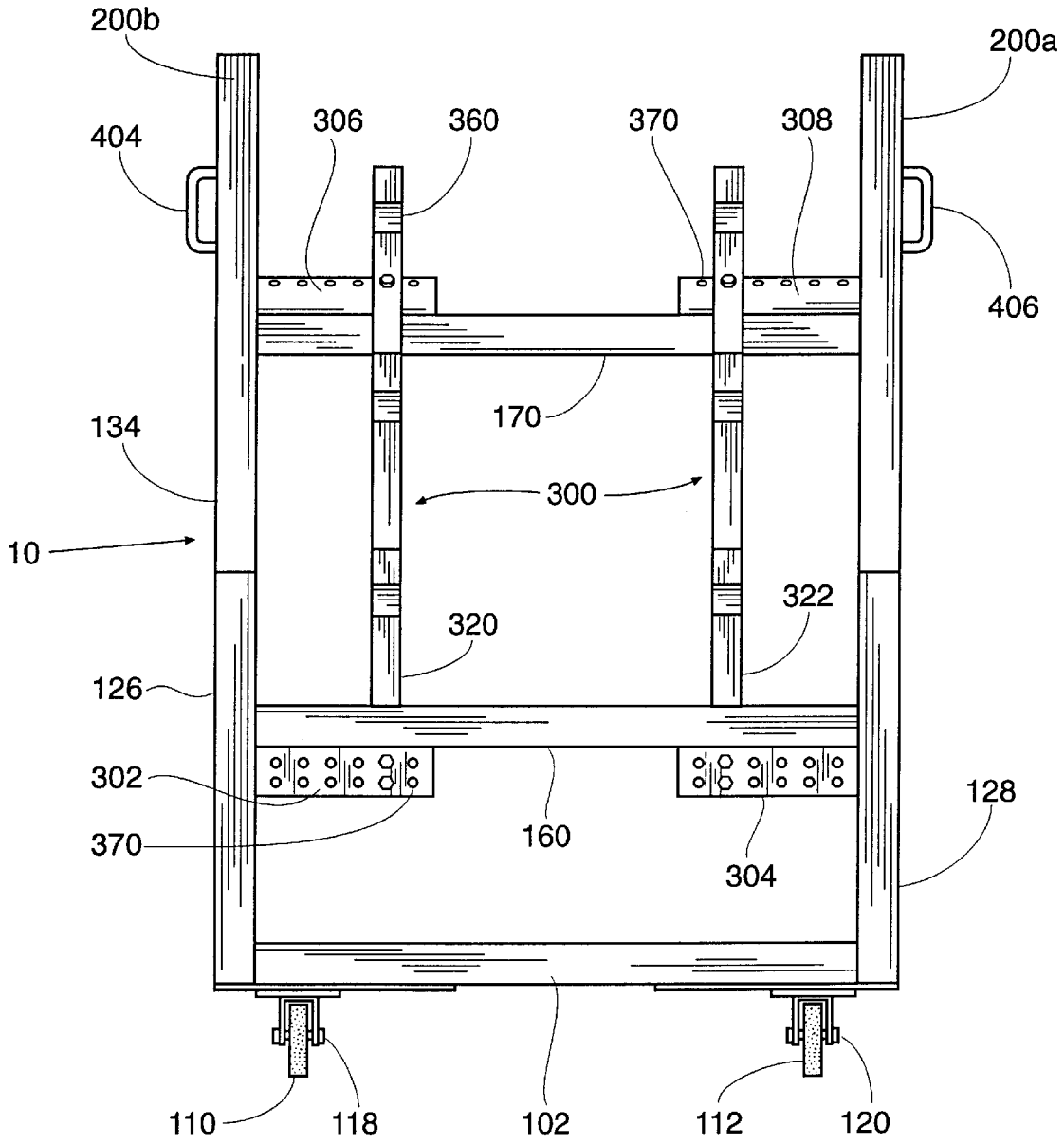
FIG. 2 is a front view of the large roll storage rack.

As best seen in FIG. 2, the outer protective frames 200*a*, 200*b* are tied together by extensions 160 and 162, and extensions 170 and 172.

The elements described above, comprise the outer protective frames 200*a*, 200*b* of the anilox roll storage rack 10. All storage of anilox rolls 20 is within the environment of these protective frames 200*a*, 200*b*. This environment is defined by imaginary planes (not shown) extending inwardly from the perimeters of the oppositely located outer protective frames 200*a*, 200*b*.

Referring again to FIG. 2, within the environment defined by the outer protective frames 200*a*, 200*b*, is mounted a width adjustable supporting frame 300. The supporting frame 300 comprises width adjustment plate 302 affixed to extension 160; width adjustment plate 306 affixed to extension 170; angularly mounted support member 320 detachably mounted to width adjustment plates 302 and 306; support hooks 360, preferably padded and fixedly attached to angularly mounted support member 310, said support hooks 360 used to support a respective end of an anilox roll 20, width adjustment plate 304 affixed to extension 160; width adjustment plate 308 affixed to extension 170; angularly mounted support member 322 detachably mounted to width adjustment plates 304 and 308; support hooks 360 fixedly attached to angularly mounted support members 322, said support hooks 360 used to support one end of an anilox roll 20; width adjustment plate 310 affixed to extension 162; width adjustment plate 312 affixed to extension 172; angularly mounted support member 324 detachably mounted to width adjustment plates 310 and 312; support hooks 360 fixedly attached to angularly mounted support member 324, said support hooks 360 used to support one end of an anilox roll 20; width adjustment plate 306 affixed to extension 162; width adjustment plate 308 affixed to extension 172; angularly mounted support member 326 detachably mounted to width adjustment plates 306 and 308; support hooks 360 fixedly attached to angularly mounted support members 326, said support hooks 360 used to support a respective end of an anilox roll 20.

The present embodiment of the invention has particular application for supporting an anilox roll 20 having two oppositely disposed and axially extending supporting journals 21*a*, 21*b*.

Seen in FIG. 2 are handles 402, 404, 406, 408, mounted to angular extensions 134, 136, 138 and 140.

In FIG. 2 the adjustment plates 302, 304, 306, 308, 310, 312, 314, and 316 are shown with twelve adjustment holes 370. The holes 370 are preferably spaced apart two inches. For instance, two-inch spacing provides a range of adjustment of fourteen inches between angular mounted members 320, 322, 324, and 326.

Figure 5:
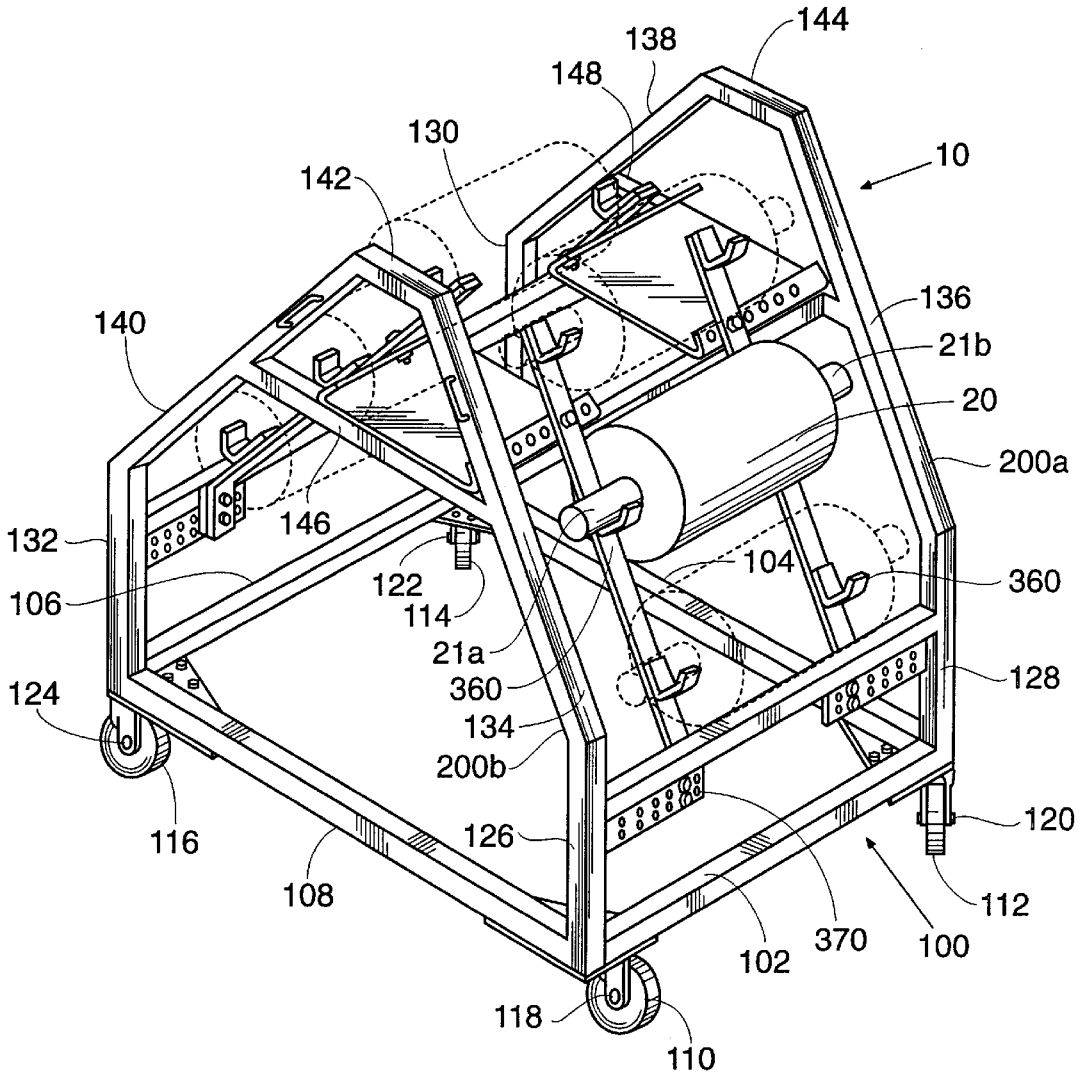
FIG. 5 is a perspective view of the large roll storage rack, with stored anilox rolls in phantom and one roll shown in solid line.

As shown in FIG. 5, the adjustment holes 370 allow a variety of anilox rolls 20 having a range of lengths of substantially different widths, to be mounted on a single rack 10. Angularly mounted members 320, 322, 324, and 326 are used to mount support hooks 360. The support hooks 360 are preferably in the form of padded J hooks. In FIG. 5 three support hooks 360 are shown on each angularly mounted member 320, 322, 324, 326. The support frame 300 of the present embodiment supports three anilox rolls 20 on each side. One anilox roll 20 is shown by the solid lines; the remaining anilox rolls 20 are shown in phantom.

The supporting frame 300 suspends all of the anilox rolls 20 within the confines of the previously defined protective environment. As an option, a plastic cover, (not shown in the illustrations of the present embodiment) extending from the top of the rack 10 to below the lowest anilox roll 20, is mounted, to further protect the anilox rolls 20.

It will be apparent that the center of gravity of each of the anilox rolls 20 will remain within the protective environment of the outer protective frames 200*a*, 200*b*.

Another embodiment of this invention is shown in FIG. 6, FIG. 7, FIG. 8, FIG. 9 and FIG. 10. This embodiment accommodates conventional anilox rolls 20 of relatively small size. Because of the small size of the anilox rolls 20, the device of this disclosure may be in the form of an alternative embodiment as shown in FIGS. 6–10. This alternate embodiment provides storage and protection of the rolls of lesser length within the rack 30. The protective environment is defined by an imaginary plane extending across the angular support members 134, 136, and 138, 140, joined at the top by extension 173, and within the protective environment of the modified rack 30.

Figure 10:
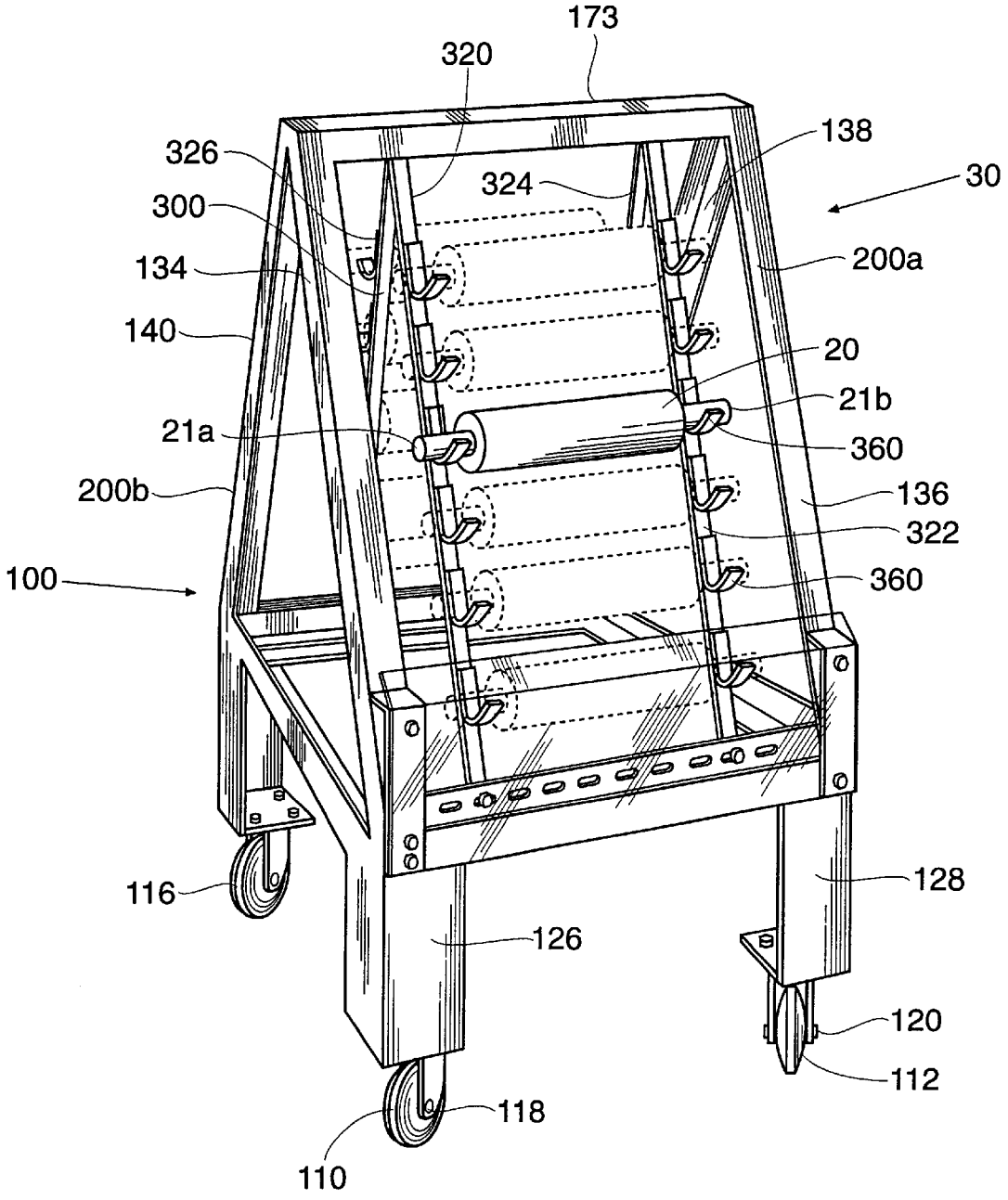
FIG. 10 is a front perspective view of the smaller roll storage rack, with small rolls in phantom and one roll shown in solid line.

In smaller racks 30, as shown in the embodiment of FIG. 6, FIG. 7, FIG. 8, FIG. 9, and FIG. 10, the supporting frames 200*a*, 200*b* are designed so that the smaller versions of the anilox rolls 20, are mounted within the confines of the protective environment defined by the outer protective frames 200*a*, 200*b*. As best seen in FIG. 10, all rolls are mounted so the center of gravity of the rolls, one of which anilox rolls 20 is shown by the solid lines, the removing anilox rolls 20 are shown in phantom, is within this protective environment.

Figure 6:
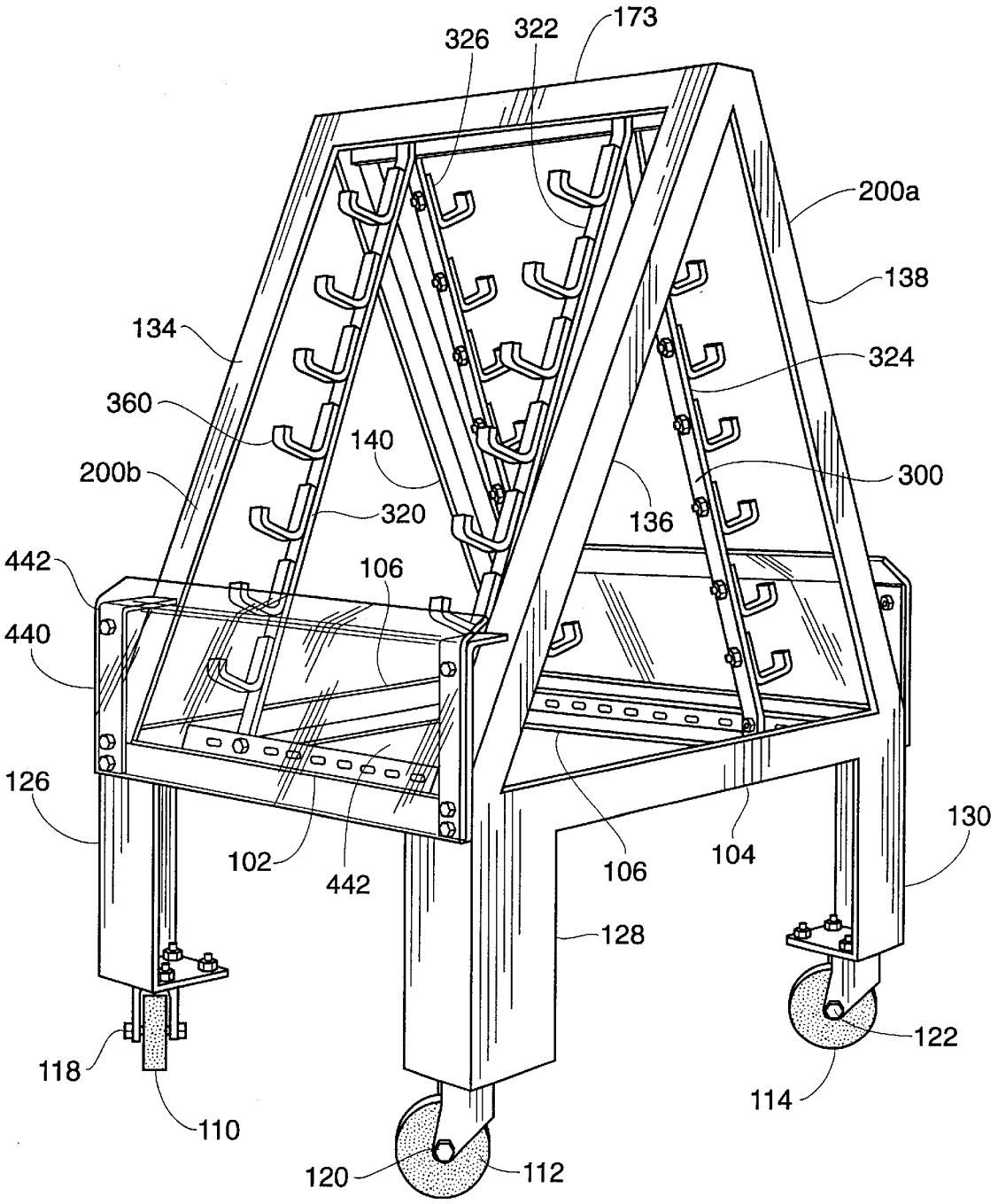
FIG. 6 is a perspective view of the small roll storage rack.
Figure 7:
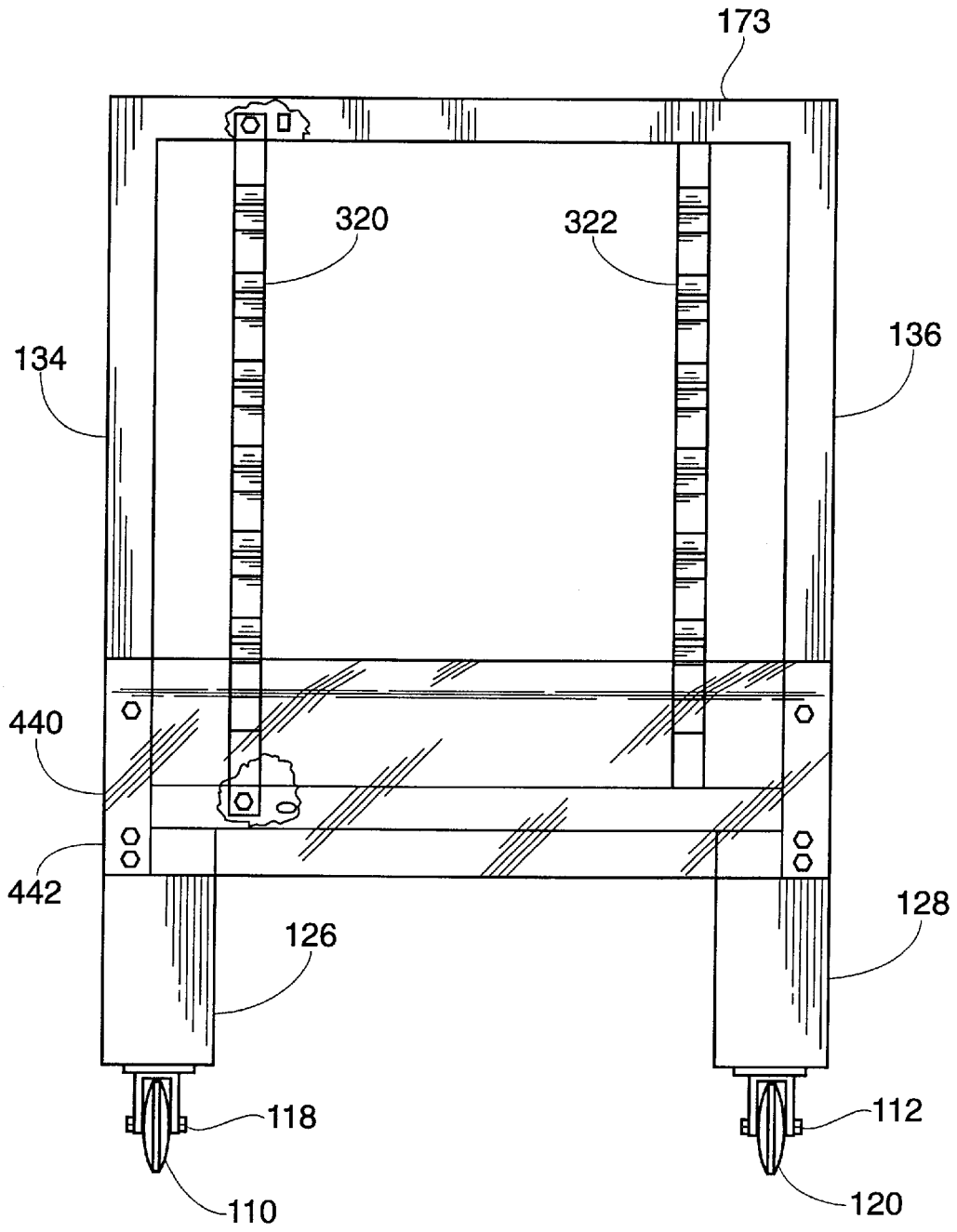
FIG. 7 is a front view of the small roll storage rack.
Figure 8:
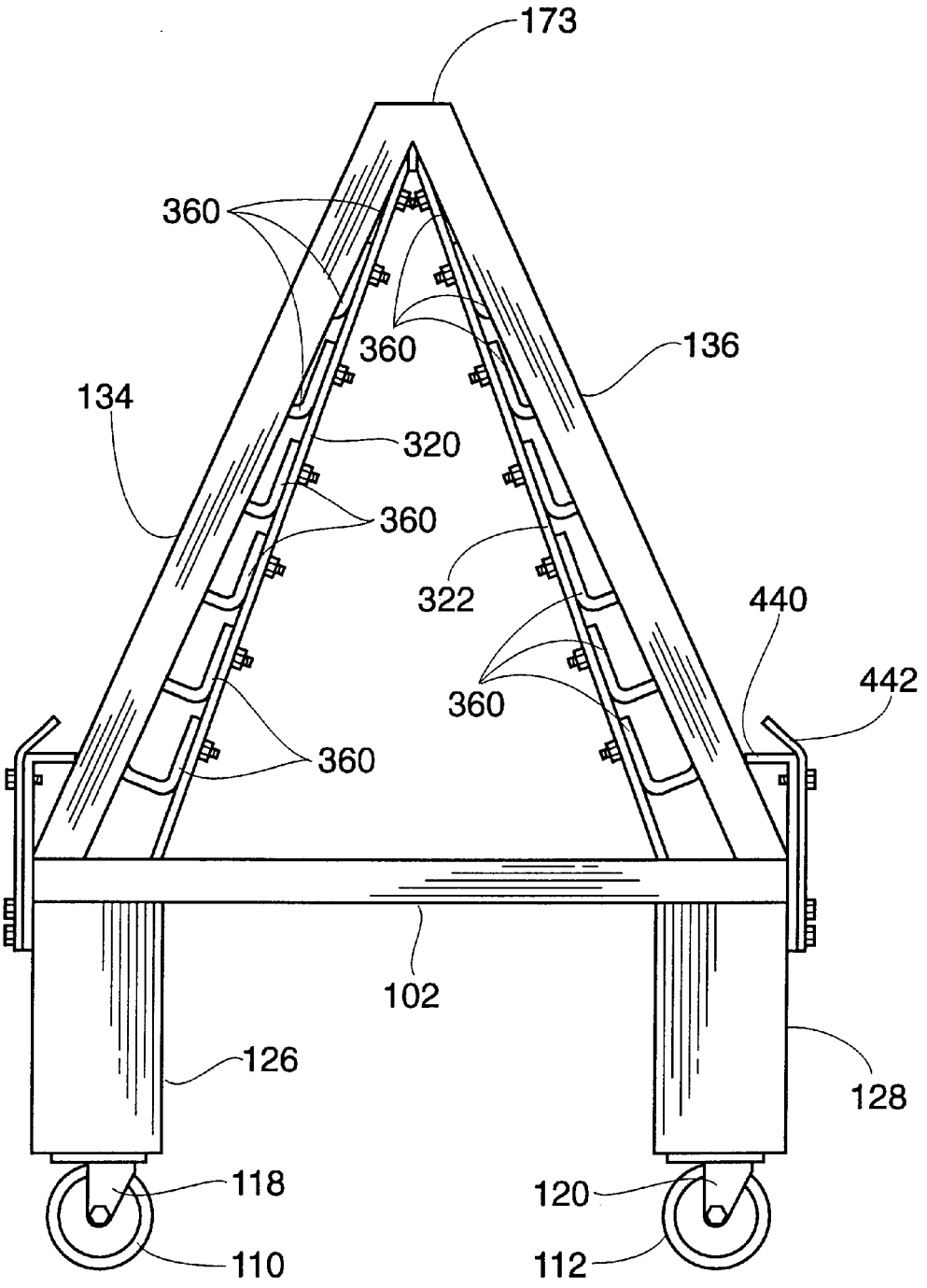
FIG. 8 is a side view of the small roll storage rack.
Figure 9:
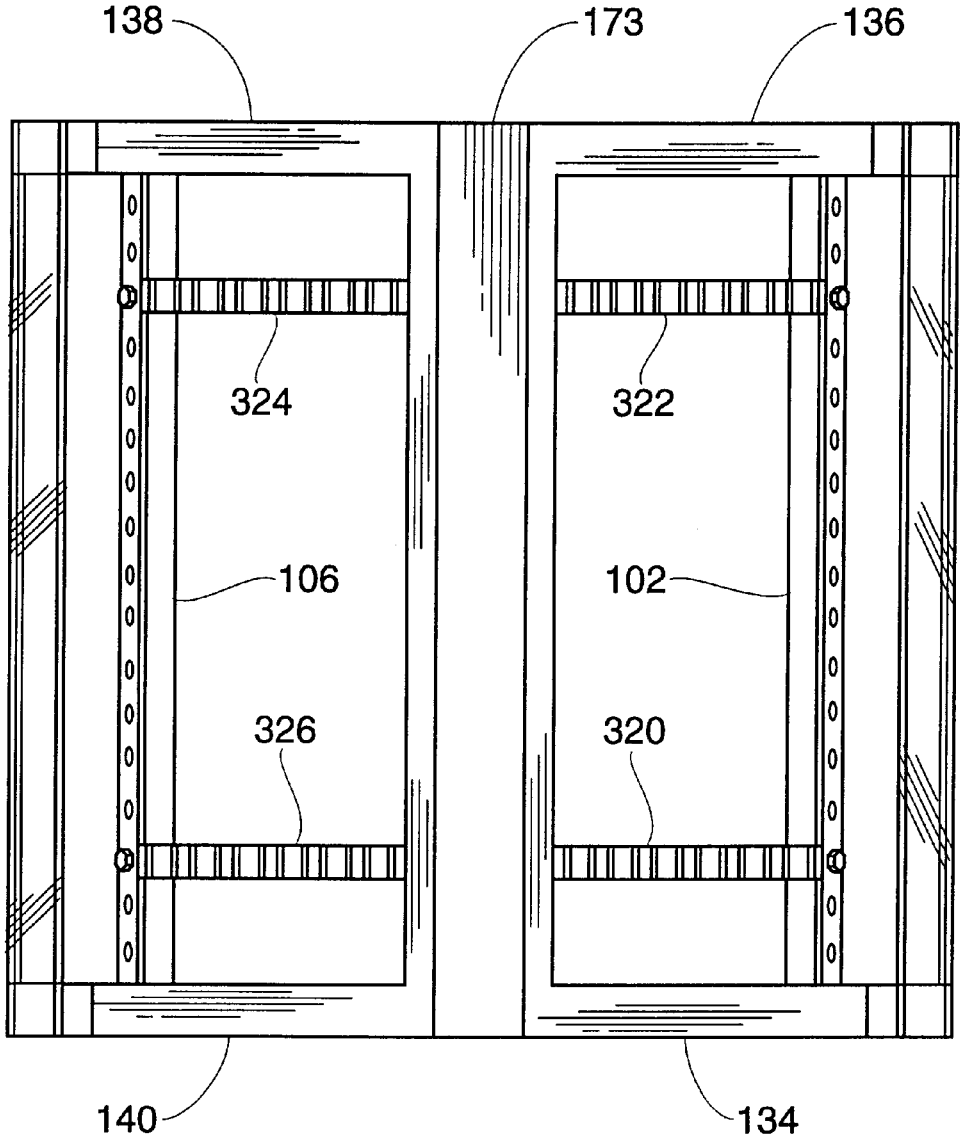
FIG. 9 is a top view of the small roll storage rack.

In the smaller rack 30, as shown in FIG. 6 and FIG. 8, mounting brackets 440, support a plastic cover 442 located therebetween to prevent damage such as that from lift trucks. A plastic outer cover 442 is further supported by extension 102. All anilox rolls 20 are held within an imaginary plane (not shown) extending perpendicularly upwards from the perimeter of the outer protective frames 200*a*, 200*b* and the space therebetween.

With request to the embodiment of FIGS. 6–10, inclusive, the rack 30 is supported by a base defined by extensions 102, 104, 106, 108. The ends of the extensions include supporting uprights 126, 128, 130, and 132. The respective uprights 126, 128, 130, and 132 are further supported by casters 110, 112, 114, and 116 further supported by the respective axles 118, 120, 122, and 124.

In both embodiments, supporting frames 300 are angled within the protective outer frames 200*a*, 200*b*, so that the lowest of the anilox rolls 20 can be removed without danger of impacting the roll above, thereby preventing injury to the surface of either roll. In the preferred embodiment, the angles of the supporting frames 300, on the racks 10 and 30, are found to be 69 degrees to the floor. The included 69 degree angle is measured with the floor as the base. This angle can be changed as desired but as the angle is changed, the rack becomes bigger, and more difficult to store and move around.

Figure 11:
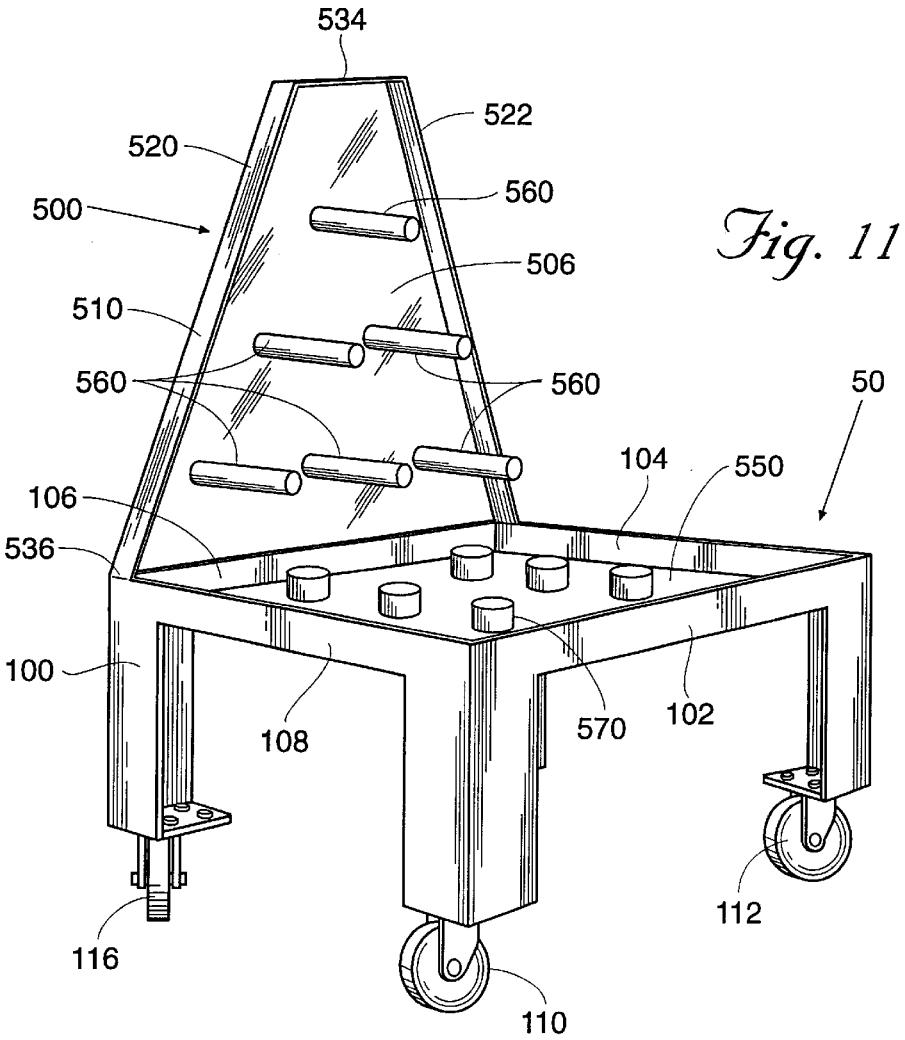
FIG. 11 is a perspective view of another embodiment of the invention showing a storage rack having support pegs.
Figure 12:
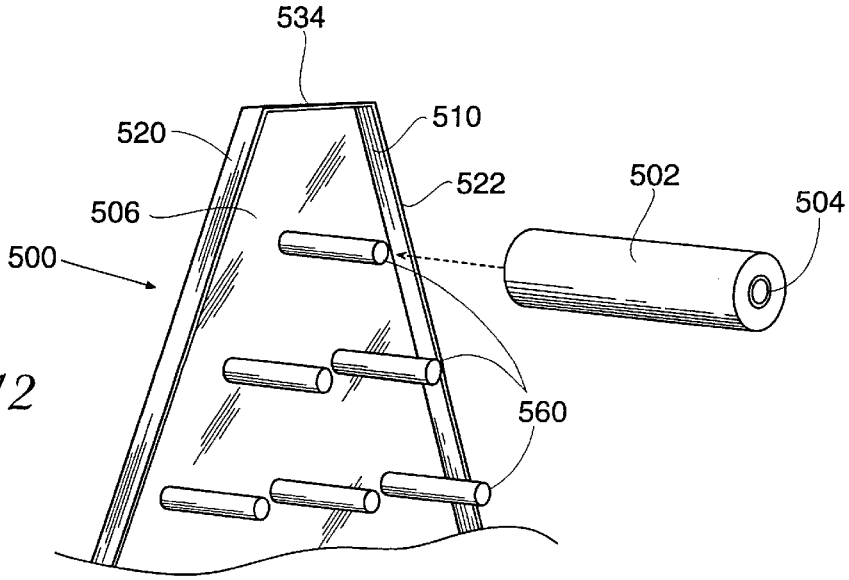
FIG. 12 is an enlarged fragmentary view of the embodiment of FIG. 11 showing the relationship between a support peg and an anilox roll.

With particular reference to FIGS. 11 and 12, an alternative embodiment can be observed as rack 50. In this embodiment the outer protective frames 200*a*, 200*b*, and the supporting frame 300, seen in FIGS. 1–10, are combined to provide a structure 500 having as its object the unification of the dual functions of protection and support. The modified structure 500, includes an inner panel 506 having a plurality of inwardly extending support pegs 560. The panel 506 is preferably of a flexible plastic material, such as sheet nylon, to absorb the usual relatively rough handling by operators after they have completed a printing job utilizing modified anilox rolls 502 (see FIG. 12). It will be observed that the modified anilox rolls 502 will be in the form of a tubular configuration having a center through bore 504. It will be further observed that the structure 500 may include a single metal strap 510 comprising integrally formed angular support members 520, 522 joined by a connecting piece 534. The respective lower ends 536 of the angular support members 520, 522 are welded to the base 100.

The rack 50 preferably includes a platform 550 supported by the frame extensions 102, 104, 106, 108 of the base 100. The platform 550 preferably includes a plurality of upstanding gear-holding pegs 570. The number of gearholding pegs 570 is preferably equivalent to the number of anilox holding pegs 560 affixed to inner panel 506. Each of the gear-holding pegs 570 is of a sufficient height to hold a pair of removable gears (not shown). It will be understood that the modified anilox rolls 502 are operationally supported by the pair of gears during normal use.

As set forth above, the essence of the invention is the dual provision of a supporting structure for anilox rolls and a protective environment for said supporting structure. Also within this concept is the provision of angular storage of anilox rolls within a protective outer frame. The conventional method of storing the rolls on a horizontally mounted bar, may cause damage to the rolls. The current invention allows more storage within the same footprint, without the cost of roll damage.

Another object of the invention is the provision of a protective outer frame incorporating an angled and adjustable inner frame, using the outer frame to protect the rolls from external damage.

It will be observed that the inventive concept, as disclosed herein, includes several illustrated embodiments. An embodiment illustrated in the views of FIGS. 1–5, inclusive, depicts a large angled protective frame surrounding a support area. This embodiment is to be used for supporting large anilox rolls within the confines of the protective frame. Another embodiment is illustrated in the views of FIGS. 6–10, inclusive. This embodiment has particular application for smaller versions of the anilox rolls. In both of the aforementioned versions it will be observed that the supporting structure is configured to provide support for anilox rolls having oppositely extending journals. Still within the protective concept of this invention there has been provided a modified version of the invention, seen in FIGS. 11 and 12, having particular application for supporting anilox rolls having through bores rather than journals.

In each of the described embodiments, the protective environment is defined by imaginary planes intersecting the outermost periphery of the protective element, such as in the defining periphery of the outer protective frames 200*a*, 200*b*, and the periphery of the modified structure 500.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A rack for storing at least one cylindrical roll member having oppositely disposed, axially extending journals, said rack comprising:

a protective environment for the roll member, said protective environment defined by an open framework comprised of interconnecting, surrounding frame members and a supporting base member;

a support structure for supporting the journals of said roll, said support structure spaced inwardly from and located entirely within said open framework, said support structure including laterally spaced, upwardly extending, inwardly angled, elongated support members;

said support structure including means for lateral adjustment for said support members and wherein said means for lateral adjustment includes a width adjustment plate having a plurality of laterally spaced openings, said openings being arranged to provide lateral adjustment and detachable support for said support members; and said support members each including releasable support means for supporting the journals of the cylindrical roll member.

2. The rack of claim 1 wherein said surrounding frame members include a pair of laterally spaced, upstanding, outer protective frame members supported by said base member.

3. The rack of claim 1 wherein said releasable support means includes at least one laterally extending journal support member.

4. The rack of claim 3 wherein said journal support member includes a layer of padding material.

5. The rack of claim 4 wherein said journal support member is J-shaped.

* * * * *